United States Patent [19]

Beaugrand

[11] 4,007,850

[45] Feb. 15, 1977

[54] SAFETY CLOSURE FOR MEDICINE BOTTLES AND THE LIKE

[76] Inventor: Eugene L. Beaugrand, 1224 Seville, Pacifica, Calif. 94044

[22] Filed: Dec. 4, 1975

[21] Appl. No.: 637,803

[52] U.S. Cl. ..... 215/216; 215/217

[51] Int. Cl.[2] ..... B65D 55/02; B65D 85/56; A61J 1/00

[58] Field of Search ..... 215/9, 216, 217, 218, 215/221

[56] References Cited

UNITED STATES PATENTS

| | | | |
|---|---|---|---|
| 3,399,796 | 9/1968 | Steiner | 215/216 |
| 3,445,022 | 5/1969 | Cilluffo | 215/9 |
| 3,741,421 | 6/1973 | Wittwer | 215/217 |

*Primary Examiner*—George T. Hall
*Attorney, Agent, or Firm*—Thomas H. Olson

[57] ABSTRACT

A safety closure for a container which makes difficult, if not impossible, access to the container contents by a child. A continuous helical thread on a container neck in which thread are formed a plurality of teeth each of which defines an abutment surface transverse to the thread. A cap interiorly threaded for engagement on the neck thread, the cap having adjacent the lower extremity thereof a pawl that engages the abutment on one of the teeth thereby preventing rotation and removal of the cap. The pawl is secured to the cap for resilient movement relative thereto and has a fingernail groove to enable adults to move the pawl out of engagement with the tooth abutments on the container neck.

6 Claims, 5 Drawing Figures

SAFETY CLOSURE FOR MEDICINE BOTTLES AND THE LIKE

BACKGROUND OF THE INVENTION

1. Field of the Invention

This invention relates to a safety closure for a container of the type used to store medicine and like hazardous substances, and more particularly to such closure which cannot be opened by young children but can be readily opened by adults.

2. Description of the Prior Art

The most pertinent prior art presently known is evidenced by the following U.S. Pat. Nos.: 3,399,796; 3,445,022; 3,514,003, 3,578,192; 3,620,400; 3,739,934, and U.S. Pat. Re. No. 27,303. The present invention affords salutary advantages over the structure described in the cited patents and in any other known prior art.

SUMMARY OF THE INVENTION

An object of the present invention is to provide a closure for a container that is difficult or impossible for a child to remove and relatively easy for an adult to remove. This object is achieved by providing a series of teeth or abutments along the helical thread on a container neck and by providing a cap having complemental threads and a resiliently biased pawl that engages the teeth on the neck so as to prevent removal of the cap by those with limited manual dexterity, such as children. The pawl, however, has a fingernail groove which can be engaged by adults to move the pawl radially outward and out of engagement with the teeth so as to permit removal of the cap.

Contributing to attainment of the object of making impossible or difficult removal of the cap by children is the fact that there is a plurality of teeth throughout the extent of the thread on the container neck. Consequently, should a young child inadvertently move the pawl outward to permit the pawl to pass one or two of the teeth, it is highly unlikely that he will possess the dexterity or concentration to retain the pawl outward throughout its entire travel over the neck thread.

Another object of the invention is to provide a safety closure that can be incorporated in existing container manufacturing apparatus without excessive modification thereto. Containers are typically formed in molding machines in which there is a mold cavity corresponding to the shape of the container. Because the teeth in the container neck are formed by depressions in the existing thread, the mold can be modified by adding material thereto to form such teeth. Accordingly existing molds can be readily modified to be adapted for use with the present invention.

A feature and advantage of the present invention is that a container having threads that are formed with teeth as described above can be used with ordinary caps so that the same container can be marketed either with an ordinary cap or a safety cap according to the present invention.

Another feature and advantage is that the cap of the present invention can be used on a container neck of proper size with ordinary threads. Although the cap has no safety characteristics when so used, it affords versatility in effecting closure of a container should the original cap therefor be mislaid.

Yet another feature and advantage of the present invention is that the cap is formed of one piece which can be inexpensively injection molded so that cost of production of the cap according to the invention is virtually the same as the cost of production of an ordinary cap.

The foregoing together with other objects, features and advantages will be more apparent after referring to the following specification and accompanying drawing.

DESCRIPTION OF THE PREFERRED EMBODIMENT

Figure 5:
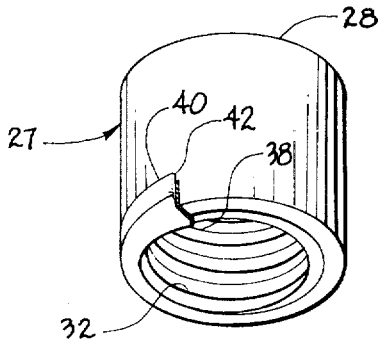
FIG. 5 is a perspective view of a cap embodying the invention.

Referring more particularly to the drawing, reference numeral 12 indicates a container such as a bottle or jug formed of glass, plastic, or like material. Container 12 has a cylindrical neck 14 which has an end 16 proximate the main body of container 12 and a distal end 18 which defines a mouth opening 20 for affording communication to the interior of container 12. Formed on the exterior surface of neck 14 is a helical thread 22.

Thread 22 defines throughout its length of plurality of teeth 24, each of which defines an abutment 26 which is oriented radially of the neck and transversly of the thread. All abutments 26 face in the same direction, that is, toward the proximate end 16 of neck 14. There is a plurality of teeth 24 and abutments 26 throughout the entire extent of thread 22, the teeth being disposed at intervals in a range of about 40° – 90°, but not an integral sub-multiple of 360°, around the exterior surface of neck 14. At the proximate extremity of thread 22 is a tooth 24' which defines an abutment 26', the significance of which will appear hereinbelow.

A cap 27 includes a hollow cylindric body 28 spanning one end of which is an end plate 30, which is preferably integral with the cylindrical body so as to form an impervious or fluid tight cap. Interiorly of cylindric body 28 is defined a helical thread groove 32 which is formed complementally to thread 22 so that cap 27 can be threaded onto neck 14 to bring cap end plate 30 into sealing relation to mouth 20.

Figure 4:
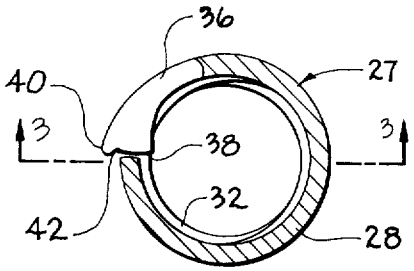
FIG. 4 is a cross sectional plan view of the cap of FIG. 3.
Figure 2:
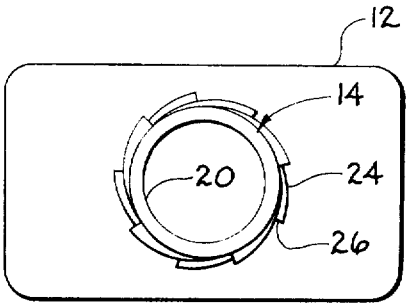
FIG. 2 is a plan view of FIG. 1.

In the axial extremity of cap 27 opposite from end plate 30, the cap is formed with an integral pawl 34. Because cap 27 is formed of resilient plastic material and because pawl 34 is integrally molded with the cap, the pawl is radially moveable relative to the cap at a pivot region 36. The cap is fabricated so that the pawl normally resides in the position shown in FIG. 4 at which position a pawl latching surface 38 extends radially inward into thread groove 32 so as to engage one of the abutments 26 on neck thread 22. The embodiment shown in the drawing has a right hand thread so that engagement of pawl latching surface 38 with one of abutment surfaces 26 prohibits counterclockwise rotation of the cap, the direction of rotation necessary for removal of the cap. The shape of pawl 34 and teeth 24 coact with the resilience of the material at pivot region 36 to permit substantially uninhibited clockwise rotation necessary to install cap 27 on container 12 to effect closure thereof. Pawl 34 on its exterior surface defines a small projection 40 in which is formed a groove or slot 42. Engagement of an adult's fingernail in slot 42 permits outward movement of pawl 34 around pivot region 36 so as to withdraw pawl latch surface 38 from engagement with abutments 26 when removal of cap 27 is desired.

Figure 3:
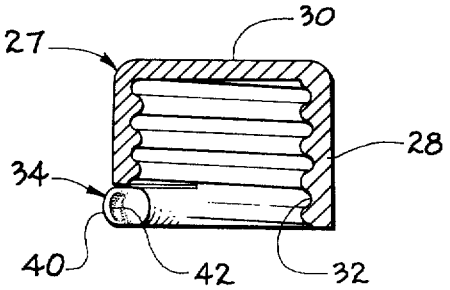
FIG. 3 is an elevation view in cross section of a cap engageable with the neck of the container of FIG. 1 taken along line 3—3 of FIG. 4 and embodying the present invention.
Figure 1:
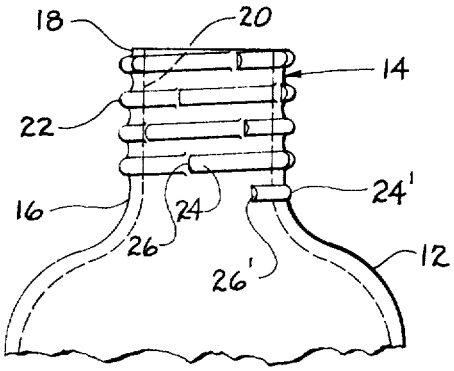
FIG. 1 is a fragmentary elevation view of a container and neck embodying the present invention.

From a comparison of FIGS. 1 and 3, it can be seen that the axial distance from the inner surface of end plate 30 to pawl latching surface 38 is equal to or greater than the axial distance from distal end 18 of the bottle neck to abutment 26'. This dimensional relationship assures that when cap 27 is completely screwed onto the bottle neck, traverse of all abutments 26 must be made in order to remove the cap.

There is a substantial number of abutments throughout the length of the thread, e.g. at least 10 and preferably between 15 and 20, depending on the length of helical thread 22. The large number of abutments affords further safety in that, should a child accidentally move pawl 34 outward to enable pawl latching surface 38 to clear one or more abutments 26, it is highly unlikely that the child will be able to retain the pawl outward for a period of time sufficient to permit total removal of the cap.

Because abutments 26 are circumferentially spaced around neck 14 by an angular distance that is not an even sub-multiple of 360°, no axially extending passage is defined by the depressions adjacent the abutments. Accordingly, even should an infant succeed in rotating cap 27 partially, the likelihood of leakage is remote because of the offset relationship of the abutments.

Inspection of FIG. 1 will demonstrate that the neck 14 will accept an ordinary or unmodified cap so long as the thread pitch and diameter are appropriate. Accordingly, container 12 can be employed as a regular container and as a safety container depending on the type of cap applied to neck 14. Moreover, cap 27 is not limited to use on a bottle wherein the thread is interrupted by teeth 24. The cap can be used on bottles with continuous threads, since pawl 34 will simply be distorted outward throughout the entire travel of the cap on the neck. Such combination does not afford a safety closure but illustrates that the present invention affords substantial versatility in use.

In forming containers 12 it is conventional to provide a mold that defines a cavity having a shape corresponding to the container and the neck. To modify an existing mold to produce threads having teeth 24 and abutments 26, it is only necessary to fill in portions of the mold opposite the desired locations of the abutments so that the present invention can be incorporated into existing equipment with minimal expenditures for tooling.

Thus it will be seen that the present invention provides a safety closure that is virtually childproof, even should the child accidentally achieve partial rotation of the cap. Moreover, the closure afforded by the present invention although perfect only when the cap is fully seated on the neck, affords a substantial degree of inaccessibility of the contents even when the cap is at some intermediate position on the neck. Finally the invention can be practiced with respect to existing production facilities with minimal modifications thereto. Although one embodiment has been shown and described, it will be obvious that other adaptations and modifications can be made without departing from the true spirit and scope of the invention.

What is claimed is:

1. A safety closure for a container of the type that includes a generally cylindrical neck having a proximate end integral with the container and a distal end defining a mouth opening for communicating with the interior of the container comprising a helical thread formed on said neck and projecting therefrom and having a plurality of convolutions of uniform profile intermediate said distal end and said proximate end, said thread having a plurality of teeth formed therein throughout the length thereof, said teeth each defining an abutment residing wholly within the profile and extending transverse to the thread and facing in a direction toward said proximate end, a cap having a cylindrical body and an end plate spanning one end of said cylindrical body, said cylindrical body defining interior thereof a helical thread groove complementally engageable with the thread on said neck, a pawl secured to said cylindrical body adjacent the end thereof remote from said end plate, said pawl having a radially extending tooth surface radially movable into said groove for engagement with the abutments on said neck thread to prevent rotation of said cap toward the distal end, means for radially resiliently biasing said pawl relative to said cylindrical body and into said groove for engagement with said abutments, and means affording a grip on said pawl for moving said pawl radially outward against said biasing means to effect disengagement between said pawl and said abutments to permit substantially unimpeded removal of said cap from said neck.

2. A safety closure according to claim 1 wherein said teeth are positioned at uniform angular intervals throughout said neck thread, said angular interval being unequal to an integral sub-multiple of 360° so that said teeth are staggered with respect to a direction axially of said neck.

3. A safety closure according to claim 2 wherein said angular interval is in the range of about 40° – 90° and is unequal to an integral sub-multiple of 360°.

4. A safety closure according to claim 1 wherein said grip affording means comprises a portion of said pawl extending radially outward thereof and having a radially extending surface, said radially extending surface defining a small groove for affording engagement therein of a fingernail to apply outward force to said pawl.

5. A safety closure according to claim 1 wherein said thread has an inner abutment at the proximate extremity of said thread, the axial dimension from said cap end plate to said pawl being equal to or greater than the axial distance from said inner abutment to said distal end so that when said end plate is engaged in spanning relation to said mouth, said pawl is disposed inward of said inner abutment.

6. A safety closure according to claim 1 wherein said cap and said pawl are integrally molded of resilient plastic or the like and wherein said resilient biasing means includes a circumferential slit in said cap adjacent said pawl, a region of said pawl adjacent said slit constituting said pawl biasing means.

* * * * *